United States Patent [19]

Zwilling

[11] Patent Number: 4,482,151

[45] Date of Patent: Nov. 13, 1984

[54] EXERCISING DEVICE

[75] Inventor: Brian R. Zwilling, Longmeadow, Mass.

[73] Assignee: Questor Corp., Tampa, Fla.

[21] Appl. No.: 499,829

[22] Filed: Jun. 1, 1983

[51] Int. Cl.[3] ..... A63B 13/00

[52] U.S. Cl. ..... 272/123; 272/122

[58] Field of Search ..... 272/122–124, 272/143; 273/171, 169, 81 A

[56] References Cited

U.S. PATENT DOCUMENTS

| | | | |
|---|---|---|---|
| 506,894 | 10/1893 | Wooster | 272/122 |
| 1,917,566 | 7/1933 | Wood | 272/122 |
| 2,447,218 | 8/1948 | Trzesniewski | 272/123 |
| 2,719,038 | 9/1955 | Massa | 272/124 X |
| 2,998,254 | 8/1961 | Rains et al. | 273/171 |

FOREIGN PATENT DOCUMENTS

| | | | |
|---|---|---|---|
| 729049 | 3/1966 | Canada | 272/122 |
| 338610 | of 1904 | France | 272/122 |

*Primary Examiner*—Robert Hafer
*Assistant Examiner*—Chris Coppens
*Attorney, Agent, or Firm*—Donald R. Bahr

[57] ABSTRACT

The disclosure embraces an exercising device such as a weight lifting device referred to as a barbell and an exercising device of a so-called dumbell type. The exercising device comprises a pair of housings mounted on a bar, each housing adapted to contain annularly-shaped weights in concentric nested relation with the innermost weights mounted on the bar and the housings secured to the bar. Each housing is provided with a cover supported on the bar and secured to the bar by releasable means. The annular nested weights in each housing are prevented against relative movements, the arrangement of weights in a housing being subject to any combination of a weight or weights with the retained weight or weights in a housing but restrained against movement in a housing and thereby render each housing and weight assembly of variable weight as desired by a user of the exerciser or weight lifting device.

11 Claims, 8 Drawing Figures

EXERCISING DEVICE

TECHNICAL FIELD

This invention relates to an exercising device and more especially to exercising devices of the barbell or dumbell type, the invention embracing variable weight units of a character wherein the number of weights in each weight unit may be varied without appreciably changing the center of gravity of each of said units.

BACKGROUND ART

Exercising devices of the character of barbells or dumbells have been used for many years including those exercising devices in which two or more weights have been used in each of the weight units but wherein the weights have been mounted in stacked relation upon a bar or rod. In such devices the addition or removal of weights is accomplished by stacking or removing one or more weights from the bar or rod. Also the addition or removal of weights from the weight units changes the position of the center of gravity of each weight unit.

The stacking of weights of a unit lengthwise on a bar occupies a substantial area of the rod or bar thus necessitating a bar or rod of substantial length to accommodate the variable weights. Furthermore, the securing means for retaining the weights may become loosened and the effective balance of the exercising device may be impaired during usage. The use of varying weights of the prior art stacked lengthwise upon a rod may place the center of gravity of each weight unit at a different distance from the user which is an important factor when the user is lifting a barbell construction.

DISCLOSURE OF THE INVENTION

The present invention pertains to an exercising device such as a weight lifting device having variable weight units referred to as a barbell and an exercising device of the so-called dumbell type comprising variable weight units mounted on a comparatively short rod or bar. The types of weight units embodying variable weights are of substantially the same character used on a long bar as in a barbell construction, or on a short bar as a dumbell construction except that the weight units of the barbell usually contain much heavier weights.

In either form, each of the weight units comprises or accommodates a group of circular annular nested ring-like weights whereby the assembly of weights occupies a small or limited lengthwise area of the rod or bar. Each of the weight unit assemblies may utilize various combinations of the weights so as to vary the weight of each weight assembly unit while still maintaining the same limited weight area of the rod or bar and without appreciably changing the center of gravity of each of the weight units.

The invention involves weight unit assemblies wherein each unit assembly includes a housing accommodating the circular annular weights in nested relation and a cover for the housing maintaining the weights in fixed relation in the housing preventing lengthwise movement of the weights, the cover being readily removable facilitating access to the weights for modifying the combination of weights. The covers also act as additional weight.

The housing and cover construction of a weight unit assembly are configurated so that any combination of weights in a unit assembly may be used and the weights utilized in any combination are held in proper relation in the housing so that the weight or weights in the housing are maintained in proper positions without any looseness, jiggling or lateral movement of the weight or weights in the housing.

The cover construction is arranged to engage each of the weights in the housing to prevent any relative movement of the weights in the weight assemblies during use of the exercising device. The housing is preferably covered by a nonmetallic resilient material to prevent damage during use and possibly injury to a user.

Further objects and advantages are within the scope of this invention such as relate to the arrangement, operation and function of the related elements of the structure, to various details of construction and to combinations of parts, elements per se, and to economies of manufacture and numerous other features as will be apparent from a consideration of the specification and drawings.

BRIEF DESCRIPTION OF THE DRAWINGS

The details of my invention will be described in connection with the accompanying drawings in which.

BEST MODE FOR CARRYING OUT THE INVENTION

Figures 1, 2:
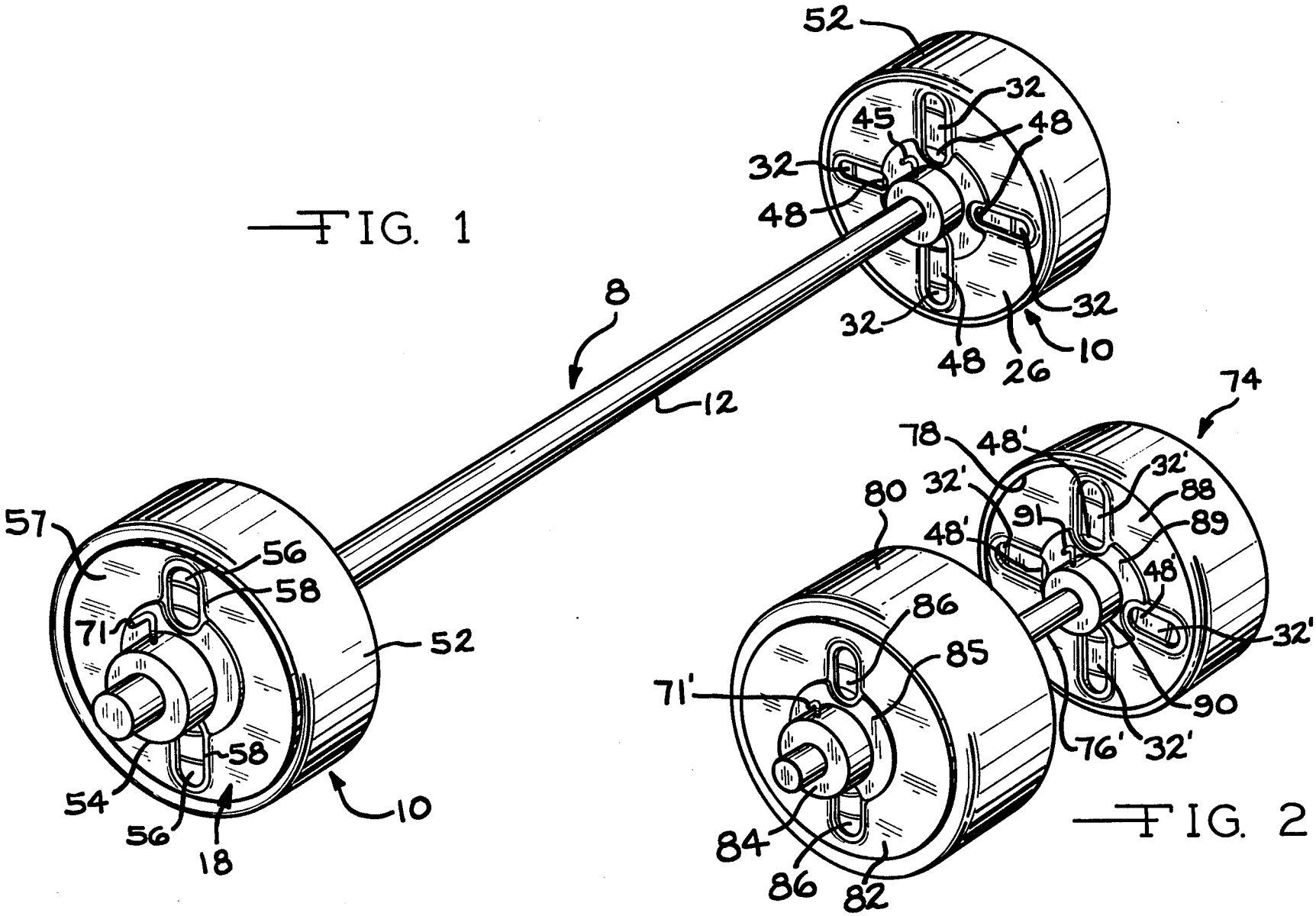
FIG. 1 is a perspective view of a form of exercising device of the invention herein referred to as a barbell.
FIG. 2 is a perspective view of another form of the exercising device herein referred to as a dumbell.

Referring to the drawings in detail and initially to FIGS. 1, 3, 4, 5 and 6, FIG. 1 illustrates the exercising device in the form of a barbell 8 which embraces two weight unit assemblies or components 10 mounted upon a comparatively long bar or rod 12, such device being referred to as a barbell or weight lifting construction.

The rod or bar 12 is of circular cross section and is of a length to enable a user to grip the rod or bar with both hands for lifting the exercising device. A weight unit assembly 10 is mounted on each end region of the bar or rod 12.

Figures 3, 4:
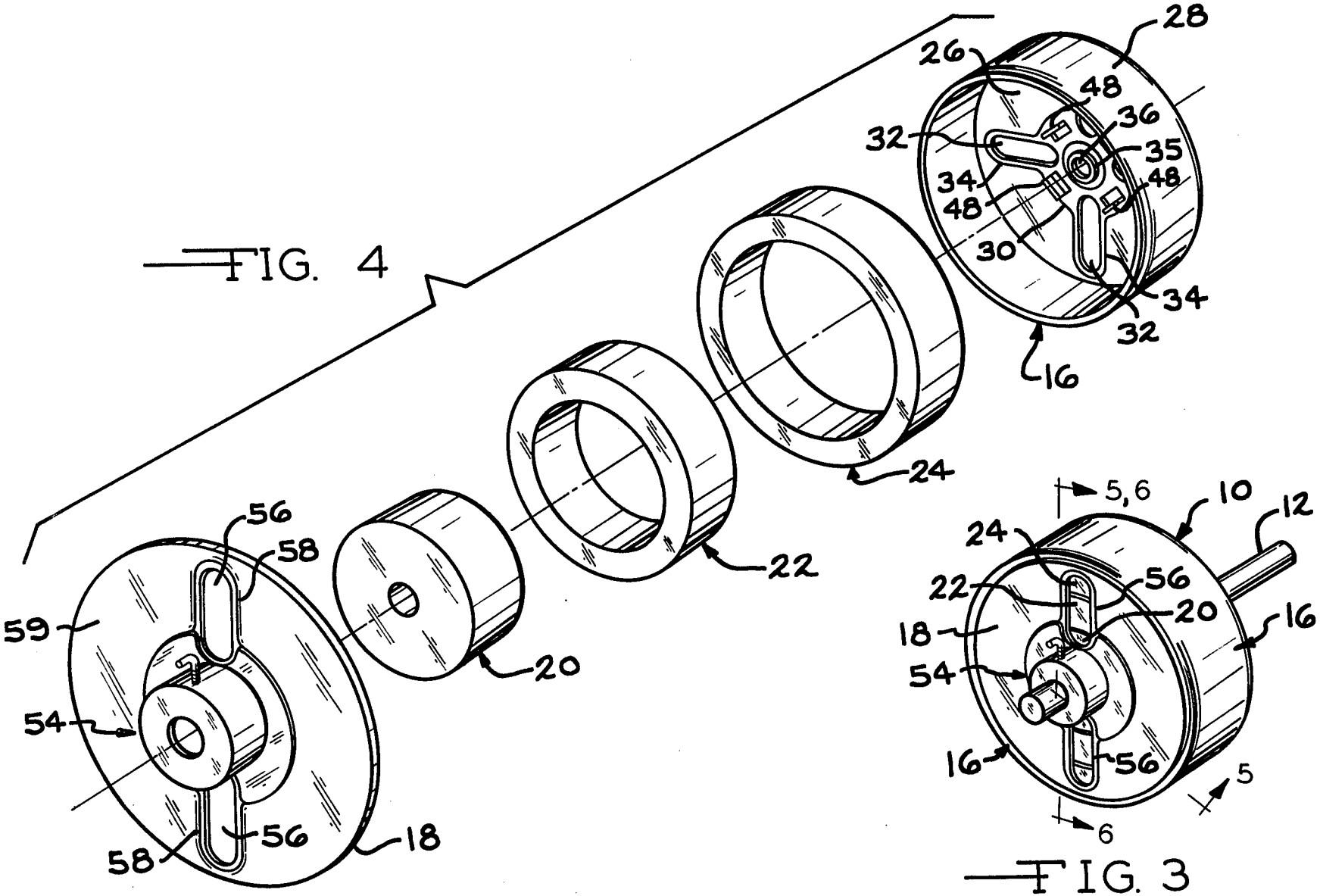
FIG. 3 is a perspective view of one of the weight unit assemblies of the exercising device.
FIG. 4 is a perspective view of components of a weight unit assembly or construction illustrating the components in disassembled relation.
Figure 5:
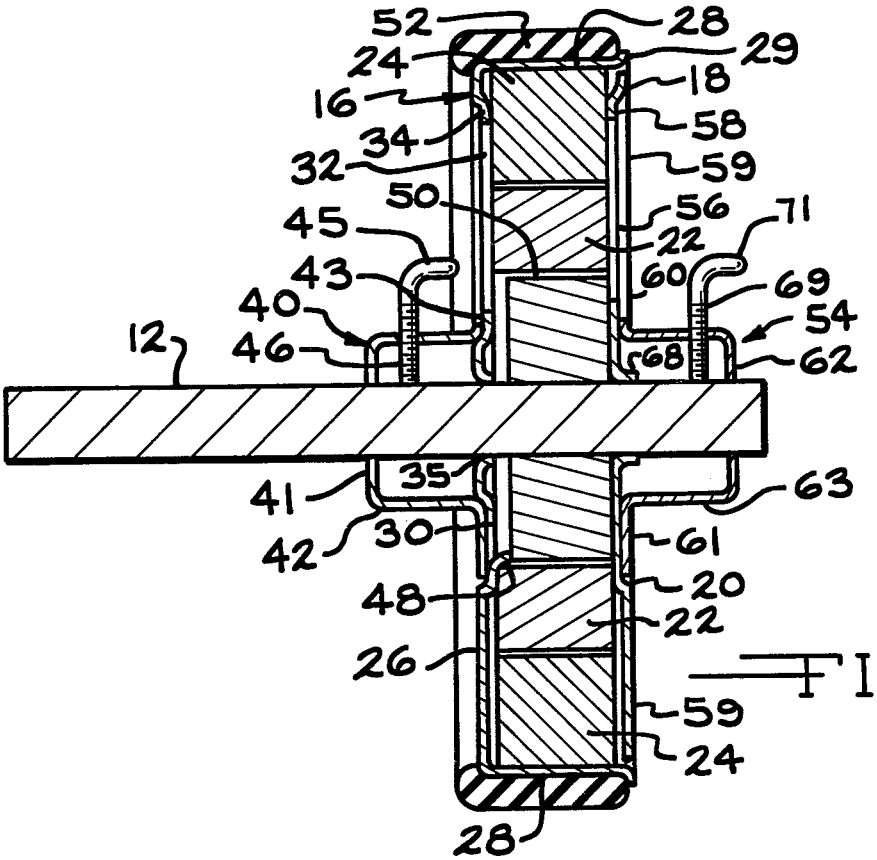
FIG. 5 is a sectional view of a weight unit assembly embodying three circular annular weights in nested concentric relation in a housing, the view being taken substantially on the line 5—5 of FIG. 3.
Figure 6:
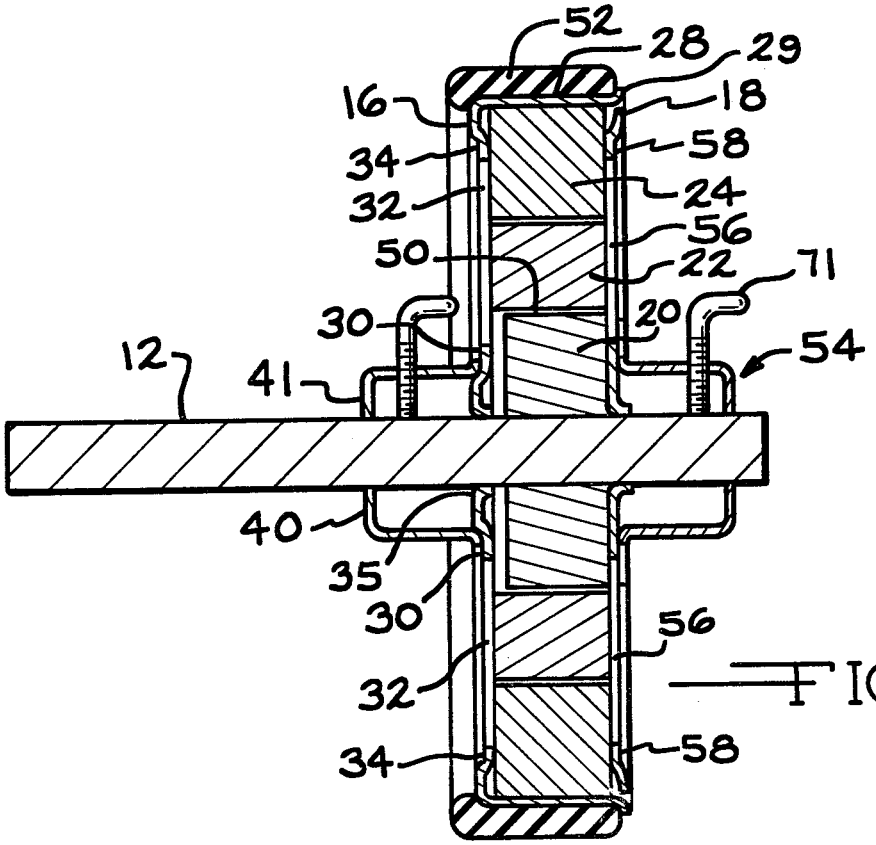
FIG. 6 is a sectional view of a weight unit assembly, the view being taken substantially on the line 6—6 of FIG. 3.

As particularly shown in FIGS. 4, 5 and 6, each of the weight units or assemblies 10 includes a metal housing 16 and a removable cover 18, preferably of metal, for the housing. Each housing 16 is of a character to accommodate a plurality or group of circular annular weights, discs or components 20, 22 and 24, there being preferably three weights within a housing. The weights are normally assembled in a housing in concentric nested relation. In a barbell or weight lifting unit, each housing 16 may be of an interior diameter of about ten inches.

Each of the housings 16 includes a planar end wall or portion 26 and a circular cylindrically-shaped peripheral wall 28 and an outwardly extending flange 29. The flange 29 tends to prevent damage to the housing in event the weight lifting unit is dropped. A circular region 30 is embossed inwardly of the end wall 26. The end wall 26 is provided with four radially extending longitudinal apertures or openings 32 as shown in FIGS. 1, 4, 5 and 6. The openings 32 in each housing 16 are surrounded or defined by raised portions 34 of the end wall 26 as shown in FIGS. 1, 4, 5 and 6. As shown in FIG. 4, the circular region 30 is provided with a flange 35 defining a central opening 36 accommodating the bar or rod 12.

A hub portion or member 40 is fashioned with a cylindrical wall portion 42 having an end wall 41 and a circular flange portion 43. The flange 43 is secured to the raised portion 30 of the housing 16 by spot welding. The end wall 41 of the hub member 40 is provided with an opening to snugly yet slidably receive the bar or rod 12.

Each housing 16 is supported on the bar or rod 12 by the flange 35 on the circular region 30 of the housing and the end wall 41 of the cup-shaped hub member 40. Each housing 16 and the hub member 40 are secured by means engaging the bar or rod 12.

The securing means illustrated comprises a member 45 having a threaded portion 46 extending through a threaded opening in a cylindrical wall portion 42 of the hub member 40 and engaging the rod or bar 12.

Figure 7:
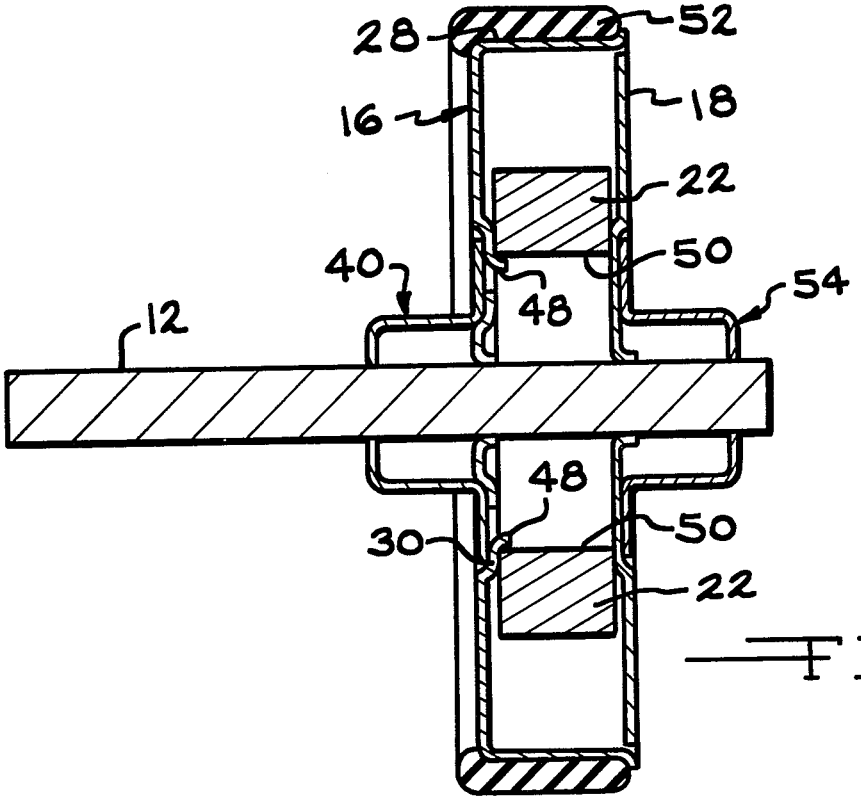
FIG. 7 is a sectional view similar to FIG. 5 illustrating an intermediate weight only in the housing.
Figure 8:
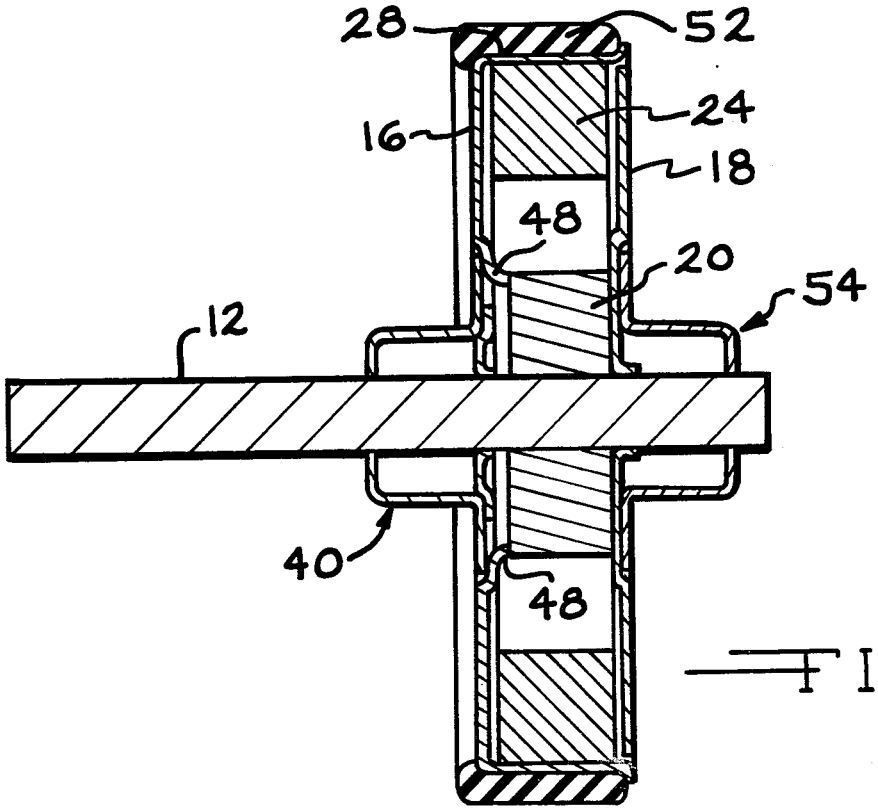
FIG. 8 is a sectional view similar to FIG. 7 illustrating inner and outer weights in the housing with an intermediate weight removed.

The circular embossed portion 30 of the planar wall 26 of each housing 16 is provided with four inwardly extending struck up projections 48, four of the projections 48 being shown in FIG. 1, three of the projections being shown in FIG. 4, one of the projections being shown in FIG. 5, and two of the projections being shown in FIGS. 7 and 8. As particularly shown in FIGS. 5 and 7, the tips of the inwardly extending projections 48 are dimensioned to engage an edge region of the inner circular surface 50 of the intermediate weight 22 for a purpose hereinafter explained.

The depth of each housing 16 determined by the peripheral wall 28 of a housing is of a dimension to receive the weights 20, 22 and 24 in nested relation as illustrated in FIGS. 5 through 8. The tips of the projections 48 engage the weight 20 to prevent endwise movement of the weight 20 along the bar or rod 12.

The peripheral wall 28 of each housing 16 is covered or provided with a layer 52 of resilient polymeric or rubber-like material to prevent damage to the weight lifting device when the same is inadvertently dropped upon a floor and to minimize injury to a user of the exercising device.

Each housing 16 is provided with a generally planar type of metal cover 18. The cover 18 is provided with a cup-like hub member 54. The cover member is provided with two elongated radial openings 56 defined within embossed portions 58 on the planar portion 59 of the cover member or plate 18. The hub portion 54 is provided with a flange 60 which is secured by spot welding to a circular embossed region 61 on the cover 18.

The generally cup-shaped hub member 54 has an outer end wall 62 connected with a peripheral wall portion 63 which is connected with the flange 60 particularly shown in FIG. 5. The open end of the cup-shaped hub member 54 is closed by the circular embossed region 61 of the cover 18. The circular embossed portion 61 has a short hub portion or flange 68 provided with an opening of a size to snugly yet slidably receive the rod or bar 12.

The peripheral wall portion 63 of the hub member 54 is provided with a threaded opening which receives a threaded portion 69 of a member 71 which, when drawn tightly, secures the cover member 18 in the open end of a housing 16 as shown in FIGS. 5 through 8. The cover may be quickly removed by releasing the member 71 from engagement with the bar or rod 12 providing access to the weights within the housing.

FIGS. 5 and 6 illustrate the weight unit assembly in which all three weights 20, 22 and 24 are assembled in nested relation in the housing 16 with the cover 18 secured to the bar or rod 12 by the member 71, portions of the cover being in engagement with each of the weights. The weights 20, 22 and 24 are of metal such as cast iron or other suitable metal.

Portions of the housing 16 are in engagement with the weights, the embossments 34 being in engagement with weights 22 and 24. The tips of the projections 48, shown in FIGS. 1, 4, 5 and 8, are engaged with the weight 20 to urge it into engagement with the circular embossed portion 61 of the cover 18. Thus the weights within the housing are engaged by portions of the housing 16 and portions of the cover 18 so that they are prevented from lengthwise movement relative to the bar or rod 12.

FIG. 7 illustrates a housing and cover assembly with only the intermediate weight 22 being disposed within the housing. As shown in FIG. 7, the inwardly extending projections 48 on the housing are dimensioned to engage the inner circular surface 50 on the weight 22. The weights 20 and 24 are removed from the housing in FIG. 7. When the weight 22 is used by itself within a housing, the four projections 48 center the weight within the housing and support the weight 22. When the cover 54 is replaced in the position shown in FIG. 7, the intermediate weight 22 is prevented from any relative movement within the housing.

FIG. 8 illustrates the arrangement when the weights 20 and 24 are inserted in the housing without the intermediate weight 22. The weight 20 is maintained against relative movement by the projections 48 and the outer weight 24 is prevented from relative movement by embossments on the housing 16 and the cover 18 as shown in FIGS. 5 and 6.

When the intermediate weight 22 is removed as in FIG. 8, the weight 20 is held in its central position in the housing by the rod or bar 12, and the outer annular weight 24, being snugly yet slidably fitted within the peripheral wall 28, is thus maintained against relative movement within the housing.

If the inner weight 20 is removed, the intermediate weight 22 will be held in a central position by means of the projections 48, and the outer weight 24 will be held in proper position by the peripheral wall 28 of a housing.

If the innermost weight 20 is removed, the weight 22 will be maintained in a central position in the housing by the projections 48, and the outermost weight 24 properly positioned by the circular peripheral wall 28 of the housing 16.

From the foregoing description it will be seen that the barbell construction with the two housing units may be utilized with one, two and three weights within each of the housings. As the weights in each unit are in radially nested relation, one, two and three weights in each of the units may be used in any combination without apprecibly changing the center of gravity of each of the weight unit assemblies. Access to the weights in each unit is attained by simply removing the cover 18.

With the cover removed, the openings 32 in the wall 26 of a housing permit the insertion of fingers or an instrument for easy removal of weights from within a housing. The openings 56 in each of the covers 18 provide a visual means for identifying the weights in a housing. As the covers 18 are readily removable, access to the weights may be had by removing the covers without disturbing the initial position of the housings 16 secured to the bar or rod 12.

Hence irrespective of the combination of weights within a housing, the weight or weights are snugly fitted so that there is no jiggling or looseness of any of the weights within a housing.

FIG. 2 illustrates a dumbell construction 74 wherein the bar or rod 76 is of comparatively short length. The housing and weight constructions of the dumbell may be considerably smaller than the housings and weight constructions utilized with the barbell exercising unit, but similar components are utilized in the dumbell construction. The rod 76 of the dumbell is preferably of the same diameter as the rod or bar 12 of the barbell construction.

The housing 78 may be of substantially the same construction as the housing 16 of the barbell construction but of smaller size. If desired, a cover or coating 80, shown on one of the weight unit constructions in FIG. 2, of polymeric or rubber-like material may be secured to the peripheral walls of the housings 78 although such a resilient coating or cover 80 is not too important on a lighter weight dumbell construction.

The diameter of the weight containing housings 78 may be of much smaller diameter than the housings 16 of the barbell construction. The annularly-shaped weights contained within the housings 78 are of much smaller size and of less weight, but three weights may be utilized in the housings in nested relation as illustrated in connection with the barbell construction.

Each end cover 82 has a hub member 84 having a flange 85 spot welded to the cover 82. An end wall of the hub member has a central opening to be snugly yet slidably received on the short bar 76. Each hub member is provided with a threaded securing means 71' for securing the cover on the bar or rod 76. The cover 82 is provided with openings 86 for the user to identify the number of weights in a housing.

Each of the housings 78 is provided with a planar wall portion 88 to which is spot welded a flange 89 of a hub member 90, the hub member 90 of each housing being provided with a threaded member 91 for securing the housings to the bar or rod 76. The wall 88 of each housing is provided with four openings 32' for facilitating removal of one or more weights from a housing.

The weights of the dumbell are of the same general configuration of the weights 20, 22 and 24 of the barbell construction but of smaller size to be received within the smaller diameter housings 78.

From the foregoing it is apparent that the dumbell construction shown in FIG. 2 has the same similar but smaller components than the barbell construction and, as the weights within each of the housings are nested together, any combination of the weights in a housing may be utilized without materially changing the center of gravity of the weight units in each of the housings.

The housing wall 88 is provided with inwardly extending projections 48' for supporting the intermediate weight when the inner and outermost weights are removed from a housing as herein explained in connection with the barbell construction.

If it is desired to change the combination of weights in the housings 78, the end covers 82 may be removed and weights removed as desired by the user from the interior of the housings, and the covers replaced on the rods 76. As is usual in dumbell constructions, the portion of the rod 76 between the weight unit assemblies is made comparatively short to accommodate a user's hand as is conventional in dumbell constructions.

Thus it will be seen that the dumbell construction shown in FIG. 2 fashioned with two weight unit assemblies has substantially the same advantages of varying the combination of weights within the housings in the same manner as hereinbefore described in connection with the barbell construction.

It is apparent that, within the scope of the invention, modifications and different arrangements may be made other than as herein disclosed, and the present disclosure is illustrative merely, the invention comprehending all variations thereof.

I claim:

1. An exercising device comprising a bar, a pair of housings mounted on the bar, each of said housings having an end wall and a cylindrical peripheral wall, each housing adapted to receive a plurality of concentric annular weights, said weights being of dimensions whereby the weights are snugly nested together in each housing, the end wall of each housing having means providing a hub portion, a cover for each of the housings, each of said covers having means providing a hub portion, said innermost weight in each housing being snugly received on the bar, the outermost weight in each housing being snugly received within the cylindrical peripheral wall of a housing, the end wall of each housing having inwardly extending projections adjacent an intermediate weight in said housing, an open area in the end wall of each of said housings to facilitate removing weights from said housing, and means for securing the hub portions of the housings and covers to the bar.

2. An exercising device according to claim 1 wherein the end walls of the housings and the covers for the housings have regions in engagement with the weights in a housing.

3. An exercising device according to claim 1 wherein three weights are received in each housing.

4. An exercising device according to claim 1 wherein the housings are of metal, and the covers for the housings are of metal.

5. An exercising device according to claim 1 wherein the outer surface of the peripheral wall of each of the housings is provided with a layer of rubber-like material.

6. An exercising device according to claim 1 wherein the outer surface of the peripheral wall of each of the housings is provided with a layer of resilient polymeric material.

7. An exercising device according to claim 1 wherein the inwardly extending projections on the end wall of each housing are adapted to support an intermediate weight.

8. An exercising device according to claim 1 wherein the annular weights are of metal.

9. An exercising device according to claim 1 wherein the means providing a hub portion for each housing is spotwelded to a housing.

10. An exercising device according to claim 1 wherein the means providing a hub portion for each of said covers is spot-welded to a cover.

11. An exercising device comprising a bar, a pair of housings mounted on the bar, each of said housings having an end wall and a cylindrical peripheral wall, each housing adapted to receive a plurality of concentric annular weights, said weights being of dimensions whereby the weights are snugly nested together in each housing, the end wall of each housing having means providing a hub portion, a cover for each of the housings, an opening in each of the covers for ascertaining the number and relative positions of weights in said housing, each of said covers having means providing a hub portion, said innermost weight in each housing being snugly received on the bar, the outermost weight in each housing being snugly received within the cylindrical peripheral wall of a housing, the end wall of each housing having inwardly extending projections adjacent an intermediate weight in said housing, and means for securing the hub portions of the housings and covers to the bar.

* * * * *